US007007913B2

(12) United States Patent
Kinder

(10) Patent No.: US 7,007,913 B2
(45) **Date of Patent: *Mar. 7, 2006**

(54) ROTATING BLOWOUT PREVENTER WITH INDEPENDENT COOLING CIRCUITS AND THRUST BEARING

(75) Inventor: Joseph Kinder, Deer Park, TX (US)

(73) Assignee: Precision Drilling Technology Services Group, Inc., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/868,560

(22) Filed: Jun. 15, 2004

(65) Prior Publication Data

US 2004/0222020 A1 Nov. 11, 2004

Related U.S. Application Data

(62) Division of application No. 10/423,105, filed on Apr. 25, 2003, now Pat. No. 6,749,172, which is a division of application No. 09/735,385, filed on Dec. 12, 2000, now Pat. No. 6,554,016.

(51) Int. Cl.
*E21B 33/06* (2006.01)

(52) U.S. Cl. ..... 251/1.2

(58) Field of Classification Search ..... 251/1.1, 251/1.2; 166/84.1, 84.3, 85.4; 137/12, 557; 277/318, 326, 336, 927
See application file for complete search history.

(56) References Cited

U.S. PATENT DOCUMENTS 1,902,906 A 3/1933 Seamark
3,023,012 A 2/1962 Wilde
3,387,851 A 6/1968 Cugini
4,098,341 A * 7/1978 Lewis ..... 251/1.2
4,208,056 A 6/1980 Biffle
4,448,255 A 5/1984 Schaffer et al.
4,484,753 A 11/1984 Kalsi
4,531,580 A 7/1985 Jones
5,022,472 A 6/1991 Bailey et al.
5,178,215 A 1/1993 Yenulis et al.
5,195,754 A 3/1993 Dietle
5,224,557 A 7/1993 Yenulis et al.
5,230,520 A 7/1993 Dietle et al.
5,251,869 A 10/1993 Mason
5,277,249 A 1/1994 Yenulis et al.
5,279,365 A 1/1994 Yenulis et al.
5,662,171 A * 9/1997 Brugman et al. ..... 166/84.3
5,678,829 A 10/1997 Kalsi et al.

(Continued)

*Primary Examiner*—Eric Keasel
(74) *Attorney, Agent, or Firm*—Mark A. Oathout

(57) ABSTRACT

A rotary blowout preventer has a first and a second fluid circuit. Each of the fluid circuits are defined into and out of a stationary body and between the stationary body, a rotating body, and two seals. The first fluid circuit is physically independent from the second fluid circuit although they share a seal interface. A fluid is introduced into the first fluid circuit at a pressure responsive to the well bore pressure. A fluid is introduced into the second fluid circuit at a pressure responsive to and lower than the pressure of the fluid in the first circuit. Adjustable orifices are connected to the outlet of the first and second fluid circuits to control such pressures within the circuits. Such pressures affect the wear rates of the seals. The system can therefore control the wear rate of one seal relative to another seal. A thrust bearing is added to share the load placed upon the upper bearings. The thrust bearing is connected between the top end of a packer sleeve and the stationary body.

9 Claims, 5 Drawing Sheets

U.S. PATENT DOCUMENTS

| | | | | |
|---|---|---|---|---|
| 5,738,358 | A | 4/1998 | Kalsi et al. | |
| 5,873,576 | A | 2/1999 | Dietle et al. | |
| 6,007,105 | A | 12/1999 | Dietle et al. | |
| 6,016,880 | A | 1/2000 | Hall et al. | |
| 6,036,192 | A | 3/2000 | Dietle et al. | |
| 6,109,348 | A | 8/2000 | Caraway | |
| 6,109,618 | A | 8/2000 | Dietle | |
| 6,129,152 | A | 10/2000 | Hosie et al. | |
| 6,227,547 | B1 * | 5/2001 | Dietle et al. | 277/336 |
| 6,554,016 | B1 * | 4/2003 | Kinder | 251/1.2 |
| 6,749,172 | B1 | 6/2004 | Kinder | |

* cited by examiner

ROTATING BLOWOUT PREVENTER WITH INDEPENDENT COOLING CIRCUITS AND THRUST BEARING

CROSS-REFERENCE TO RELATED APPLICATIONS

This application is a divisional of U.S. Utility patent application Ser. No. 10/423,105 filed Apr. 25, 2003 (U.S. Pat. No. 6,749,172) which is a divisional of U.S. Utility patent application Ser. No. 09/735,385, filed Dec. 12, 2000 (U.S. Pat. No. 6,554,016) and claims the benefit of same.

STATEMENTS REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Description of the Related Art

U.S. Pat. No. 5,178,215 serves as a starting point for the departure made by the present invention. The disclosure of U.S. Pat. No. 5,178,215 is incorporated herein by reference and includes a general discussion of an existing rotary blowout preventer which is fluid actuated to grip a drill pipe or kelly, and the controlled circulation of a fluid to lubricate and cool bearings and seals, and to filter particulate matter.

These existing rotary blowout preventers have an annulus between an outer housing and a rotary housing. Such systems use rather large bearings which require a rather large clearance. Such an arrangement has positive effects but also results in "wobbling" between the rotary housing and the outer housing. The wobbling creates heat, "nibbles" the seals, etc. A fluid is introduced into and circulates through the annulus between the outer housing and the rotary housing to cool the seal assemblies, the bearings and to counteract heat generated by contact between the seals and the rotary housing (wellhead fluid temperatures may normally be about 200° F., and during rotation, without cooling, the temperature would readily increase to about 350° F. and destroy a seal in a relatively short time). The circulated fluid also removes foreign particulate matter from the system. Pumps are used to maintain a fluid pressure in the annulus at a selected pressure differential above the well bore pressure.

The bearings in these rotary blowout preventers may normally operate at a temperature of about 250° F. Such bearings are subjected to a significant thrust load, e.g. 2,000 lbs.-force, due in part to an upward force created by well bore pressures and placed upon a packer assembly and a sleeve in the rotary housing. Such a thrust load will generate significant heat in a bearing rotating at, for example, 200 rpm. Heat, and heat over time, are important factors which may lead to bearing failure. For example, bearings may immediately fail if they reach temperatures of about 550° F. Even at temperatures of 250° F. a bearing may fail after a significant period of use, for example, twenty days of rotation at 200 rpm when subjected to a significant thrust load.

Such existing rotary blowout preventers are very functional at wellhead pressures up to 2000 psi. However, for reasons discussed herein, there are added challenges when wellhead pressures are in the range of, for example, 2500 psi to 5000 psi.

For example, as suggested, the continued and trouble free operability of such rotary blowout preventers is dependent, in part, upon the life of the seals and bearings within the rotary blowout preventer. The seals have a "pressure/velocity" or "pv" rating which may be used to predict the relative life of a seal given the pressure and velocity conditions to be borne by a seal. When considering "PV" rating, it is significant to note that a linear relationship does not exist between the life of a seal and the increases in pressure or rotational velocity to which a seal will be subjected. Rather, the life of the seal decreases exponentially as the pressure or rotational velocity to which the seal is subjected is increased.

As such, when well bore pressures increase to ranges from 2500 psi to 5000 psi, the loads, the wear and the heat exerted on seals and bearings within a rotary blowout preventer pose a greater challenge to the operations and life of the seals and bearings. This must be considered in the context of the fact that well bore operations may be shut down for maintenance work when significant wear of seals or bearings, significant "nibbling" of seals, or seal/bearing failure occurs. Such shut downs can significantly affect the profitability of well bore operations.

BRIEF SUMMARY OF THE INVENTION

This rotary blowout preventer has a first and a second pressurized fluid circuit. Each of the fluid circuits are defined into and out of a stationary body and between the stationary body, a rotating body, and two seals. The first fluid circuit is physically independent from the second fluid circuit although they share a seal interface. A fluid is introduced into the first fluid circuit at a pressure responsive to the well bore pressure. A fluid is introduced into the second fluid circuit at a pressure responsive to and lower than the pressure of the fluid in the first circuit. Adjustable orifices are connected to the outlet of the first and second fluid circuits to control such pressures within the circuits. Such pressures affect the wear rates of the seals. The system can therefore control the wear rate of one seal relative to another seal. A thrust bearing is added to share the load placed upon the upper bearings. The thrust bearing is connected between the top end of a packer sleeve and the stationary body.

DETAILED DESCRIPTION OF THE INVENTION

Figure 1:
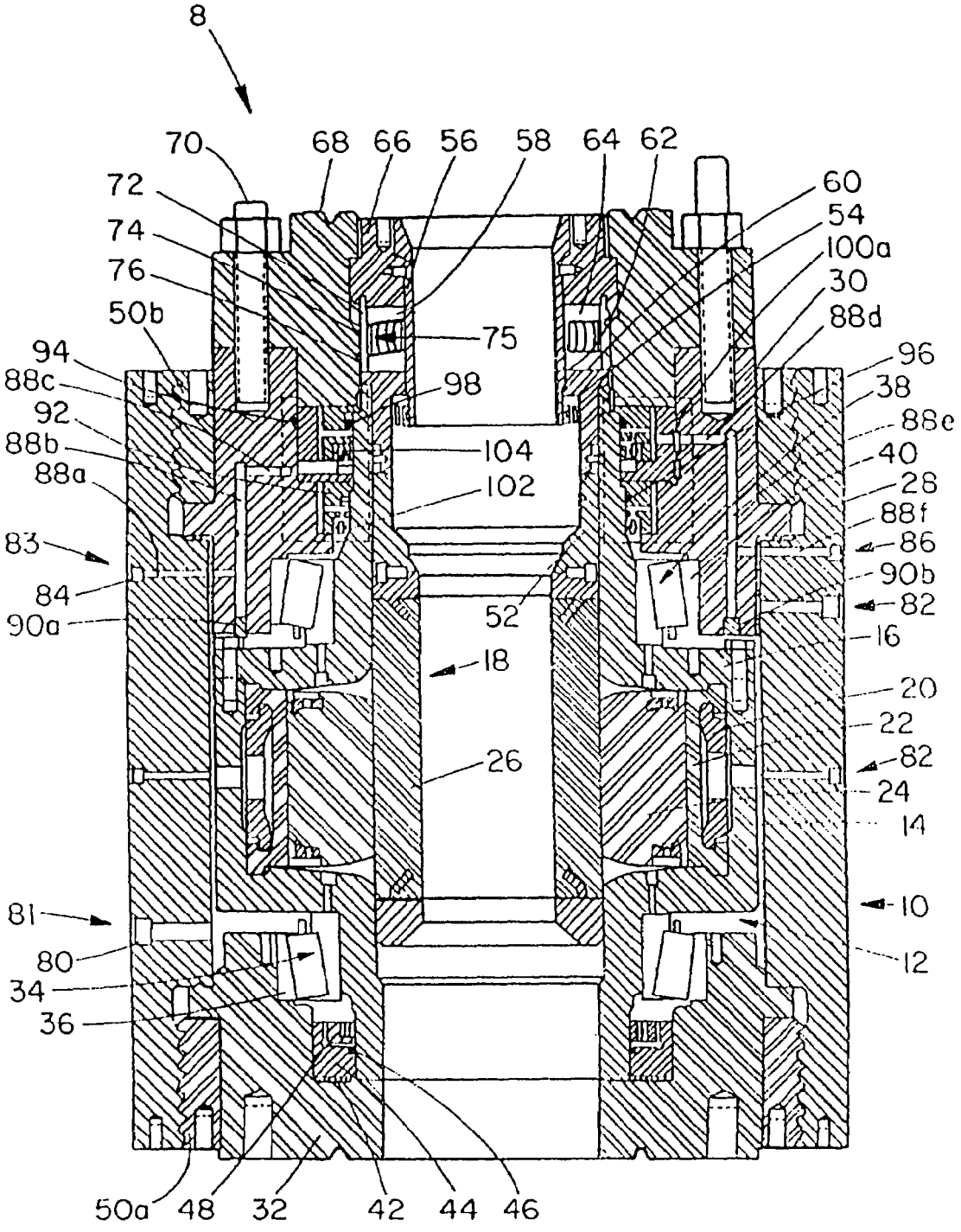
FIG. 1 is a sectional view of a rotary blowout preventer incorporating the invention(s).
Figure 2:
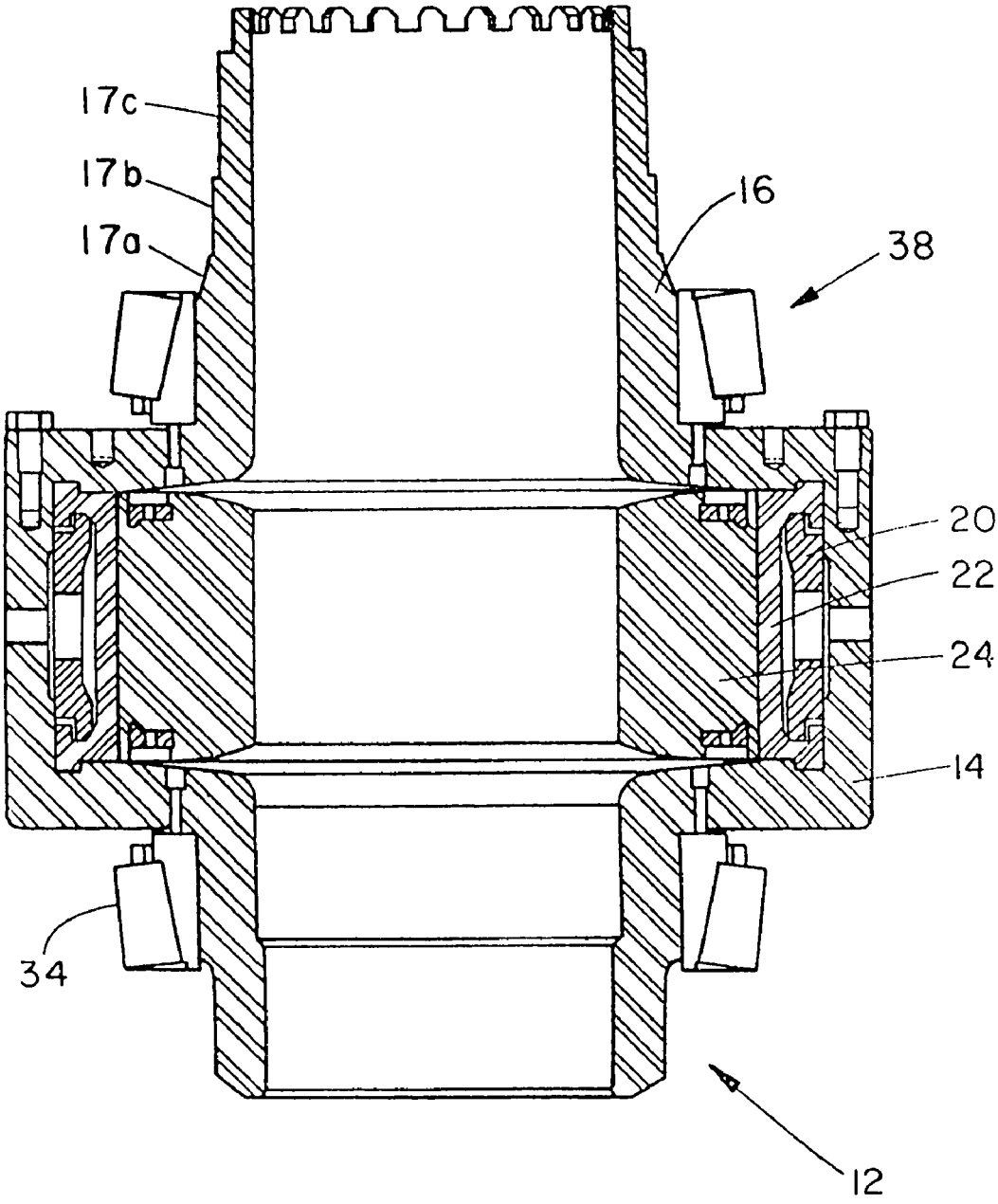
FIG. 2 is a sectional view of the rotating body without the packer sleeve.

Referring to FIGS. 1 and 2, the rotating blowout preventer 8 generally includes a stationary body 10 which houses a rotating body 12. The rotating body 12 includes a rotating housing 14, a rotating housing cover plate 16 and a packer assembly 18. The packer assembly 18 has a split keeper ring 20, an outer packer 22, an inner packer 24 and a packer sleeve 26. The stationary body 10 generally includes a body 28 with a top closure 30 and a bottom closure flange 32.

A lower bearing 34 is mounted between the stationary body 10 and the rotating body 12 in a cup 36. An upper bearing 38 is mounted between the stationary body 10 and the rotating body 12 against a cup 40. A bottom thrust bearing 42 is mounted between the stationary body 10 and the rotating body 12 on the bottom closure flange 32.

A first or bottom seal carrier 44 is mounted between the stationary body 10 and the rotating body 12 and includes a groove for the mounting of a first seal 46, which may, for example, be a seal of the type marketed by Kalsi Engineering, Inc. A bearing 48, for example, a type marketed by Kaydon is mounted between the first seal carrier 44 and the rotating body 12. A locking nut 50*a* may be used for attaching the bottom closure flange 32 to the body 28.

Packer adapters 52 and 54 are connected to the packer sleeve 26. A packer-pulling sleeve 56 engages the upper end of the packer adapter 54. A thrust bearing 58 has a lower end 60 connected to a top end 62 of the packer sleeve of the rotating body 12, and an upper end 64 connected to a top closure 66 of the stationary body 10. The lower end 60 of the thrust bearing 58 is rotatable. The top closure 66 is held in place by a top closure flange 68 and studs 70. The thrust bearing 58 is mounted inside a bearing retaining ring 72. The bearing retaining ring 72 has openings between the thrust bearing o-rings 74 and 76 for introduction, circulation and outlet of a cooling fluid as part of a thrust bearing cooling and lubricating circuit 75. The thrust bearing 58, may be a commercially available thrust cylindrical roller bearing or it may be custom built.

Figure 4:
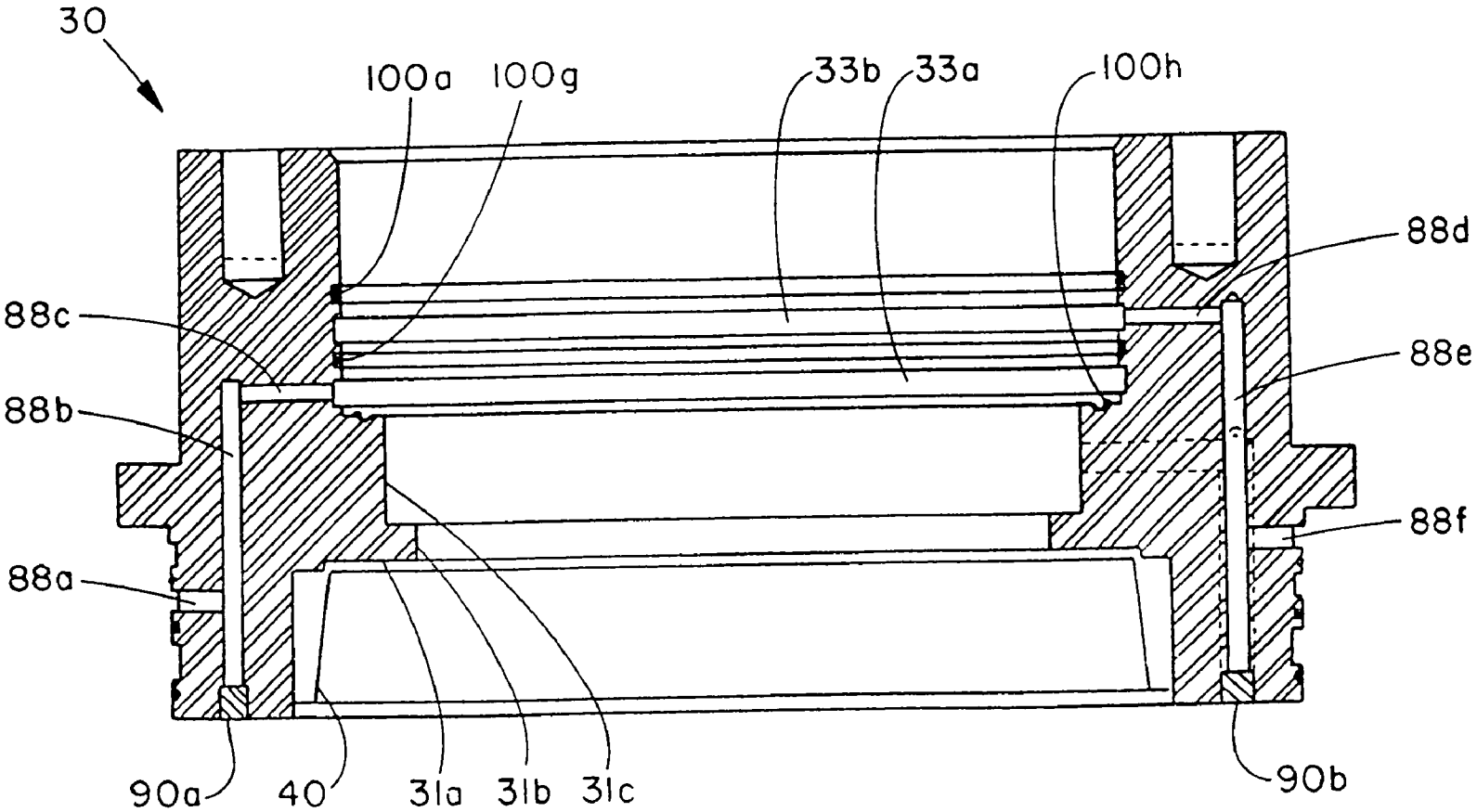
FIG. 4 is a sectional view of the top closure.

The body 28 defines an inlet orifice 80 and an outlet orifice 82 of a first fluid or actuating, lubricating, cooling and filtering circuit 81. The first fluid circuit 81 is further defined by the annular space between the rotating body 12 and the stationary body 10 and cools, lubricates and filters the region between the rotating body 12 and the stationary body 10 including the lower bearing 34 and the upper bearing 38. FIG. 2 shows surfaces 17*a* and 17*b* of the rotating housing cover plate 16 which help define the first fluid circuit 81 between the rotating body 12 and the second seal carrier 92. FIG. 4 shows annular cup 40 and annular surfaces 31*a,b* and *c* in top closure 30 which also define in part the first fluid circuit 81. The first fluid circuit 81 loads first seal carrier 44 and one side of first seal 46 as well as second seal carrier 92 and one side of second seal 96.

The rotating blowout preventer 8 has a second fluid or lubricating, cooling and filtering circuit 83. The second fluid circuit 83 has an inlet orifice 84 and an outlet orifice 86 which may be tubular and which may be defined by the stationary body 10 such as by the body 28 and the top closure 30 and may be made, for example, by cross-drilled lines 88*a,b,c,d,e*, & *f* in stationary body 10 and top closure 30. The second fluid circuit 83 further has annular voids defined by the third seal carrier 94 itself, and between the third seal carrier 94 and annular channels 33*a* and 33*b* (FIG. 4) in top closure 30. FIG. 2 shows surface 17*c* of the rotating housing cover plate 16 which helps define the second fluid circuit 83 between the rotating body 12 and the third seal carrier 94. The cross-drilled lines 88*b* and 88*e* may be isolated from the first fluid circuit by, for example, plugs 90*a* and 90*b* respectively.

As discussed above the annular voids defined intermediate top closure 30 and rotating housing cover plate 16 are for the mounting of a second or middle seal carrier 92 and a third or top seal carrier 94 (the first seal carrier 44 is placed in an annular void defined by rotating housing 14 and bottom closure flange 32). A second seal 96 is mounted in the second seal carrier 92 and a third seal 98 is mounted in the third seal carrier 94. The first, second and third seal carriers 44, 92, 94 are preferably hydraulically balanced floating seal carriers for carrying seals 46, 96, 98. Such seals may be, for example, seals of the type marketed by Kalsi Engineering, Inc.

Figure 3:
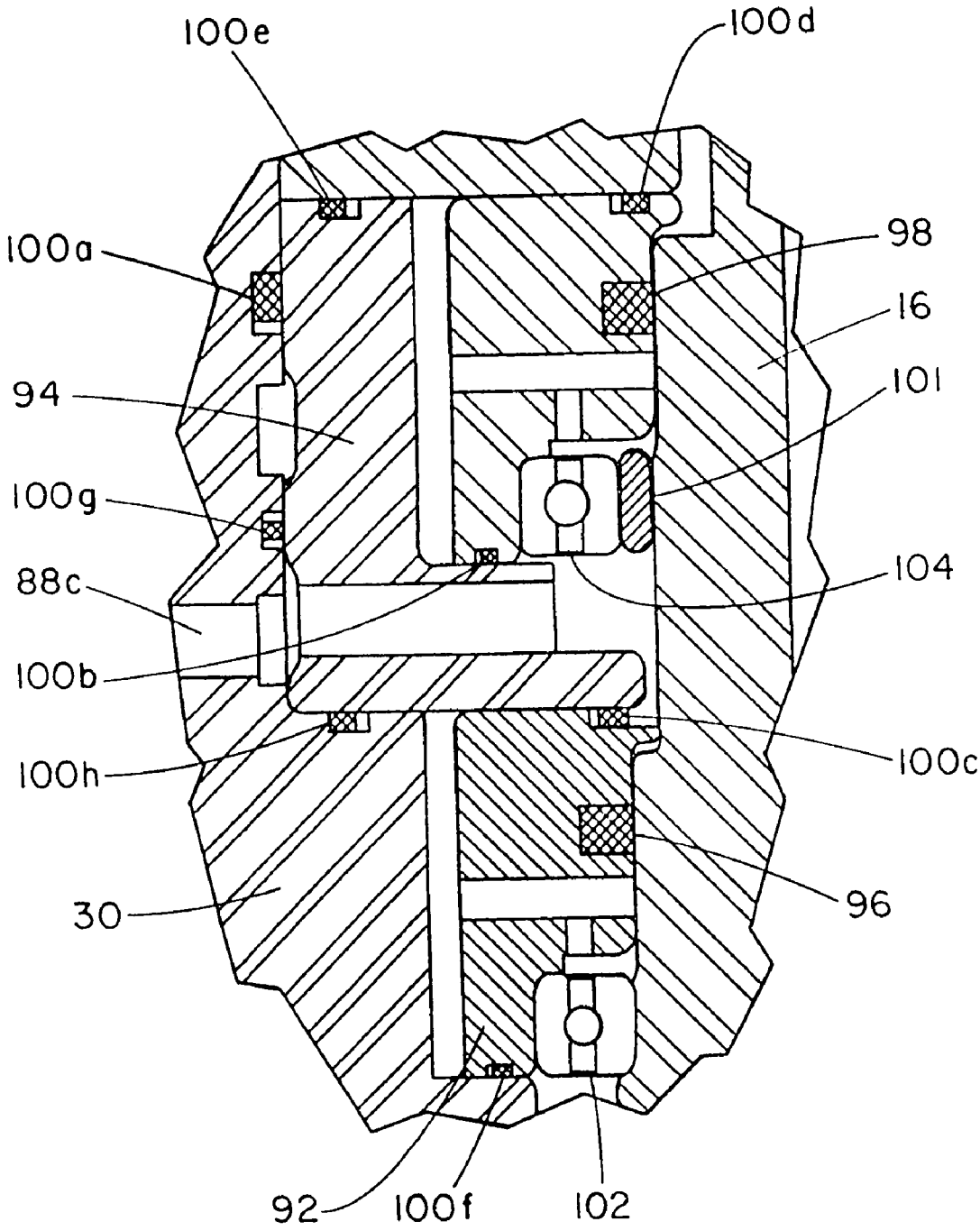
FIG. 3 is an enlarged view of the middle and upper seal carriers shown in FIG. 1.

Referring to FIG. 3 various seal or o-rings 100*a,b,c,d,e,f,g* and *h* are mounted in grooves around the second and third seal carriers 92 and 94, and the top closure 30. Bearing 102 is mounted in the second seal carrier 92 and in the first fluid circuit 81. Bearing 104 is mounted in the second fluid circuit intermediate the third seal carrier 94 and a bearing spacer 101. As discussed above, annular voids are defined by the top closure 30 and/or by the second and third seal carriers 92 and 94. These annular voids form part of the first and the second fluid circuits 81 and 83.

The rotating blowout preventer 8 and the fluid circulation circuits may be operated as discussed below. This system is especially useful in well bore environments where the pressure of the well bore exceeds 2500 psi on up to and exceeding 5000 psi.

The description following in the next two paragraphs serves as an example of the implementation of the invention and is not intended to quantify any limits on the value of features expressed in terms of pressure or time. However, such quantified values may be individually or collectively claimed as a preferred embodiment of the invention.

A fluid for actuating, for cooling, for lubricating and for removing foreign particulate matter is introduced into the first fluid circuit 81 at a pressure P1. The pressure P1 is at or about well bore pressure plus about 300 psi (i.e. P1 ranges from 300 psi to 5300 psi depending upon well bore pressure). At the same time, a like or a similar fluid is introduced into the second fluid circuit 83 at a pressure P2 in the range of about 35% to 65% of the pressure P1. The second seal 96 experiences a pressure differential from P1 to P2 and the third seal 98 experiences a pressure differential from P2 to atmosphere (or to the pressure of the thrust bearing cooling circuit 75). The pressure P2 may nominally be introduced into the second fluid circuit 83 at approximately one-half the pressure P1. Next, data may be gathered by one skilled in the rotating blow out preventer art relating to wear rates and conditions for bearings and seals within the rotary blowout preventer 8. Then, such data may be used to empirically determine optimal pressure settings, pressure differentials and pressure changes to be made in response to variables such as changes in the well bore pressure in order to maintain the integrity of the seals and bearings. More specifically, it will be advantageous to control the pressure differentials such that the second seal 96 has a wear rate exceeding the wear rate of the third seal 98. This is because if excessive wear is inflicted upon the second seal 96 prior to being inflicted upon the third seal 98, a leak past the second seal 96 will create an increase in pressure in the second fluid circuit 83 as detected by controls such as pressure transducers, in the control system 110. Then, the pressure increase detected in the second fluid circuit 83 may be used to infer or signal the possibility of the infliction of excessive wear on the third seal 98 (the timing of such an infliction of excessive wear on the third seal 98 being dependent upon a variety of variables such as well bore pressure, working rotational velocity, the current condition of the third seal 98, etc.) thus prompting at least the consideration of maintenance operations. Accordingly, maintenance operations may be fore planned and fore scheduled prior to a leak past third seal 98. Comparatively, the infliction of excessive wear on the third seal 98 prior to the infliction of excessive wear on the second seal 96 (or the infliction of excessive wear on the upper seal in the existing rotary blowout preventers) can result in a leak to atmosphere and an immediate shutdown or "kill" of well operations.

In a more specific example, if the well bore pressure is 4000 psi, then the pressure P1 could be about 4300 psi, and the pressure P2 could be nominally about 2150 psi (incidentally the pressure seen from above the third seal 98 could be about 60 psi). Then the pressures of the well bore, P1 and P2 can be detected (e.g., every fifty to one hundred milliseconds) in the control system 110 and the pressures P1 and/or P2 adjusted as suggested by empirical data or experience to, in anticipation of the infliction of excessive wear on a seal, cause the second seal 96 to incur excessive wear prior to the third seal 98. As mentioned above, this sequence of events will suggest to operators that maintenance work should be planned and conducted within, and dependent upon operational variables, about six hours.

Figure 5:
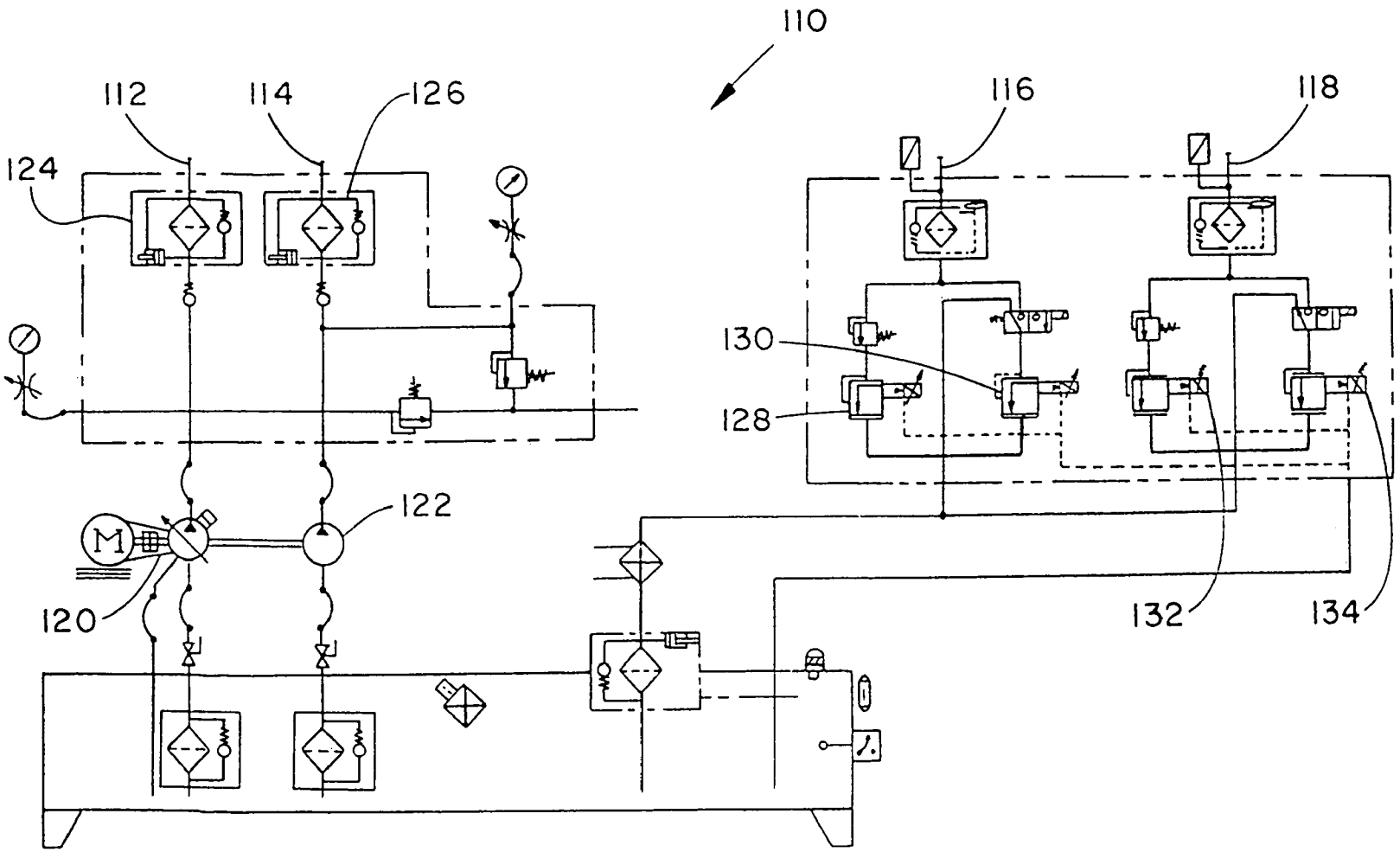
FIG. 5 is a schematic view of a control system which may be used in the invention(s).

Referring to FIG. 5, a control system 110 which may be used with the rotary blowout preventer is shown. The control system 110 generally connects via line 112 to the inlet orifice 80 of the first fluid circuit 81 and via line 116 to the outlet orifice 82 of the first fluid circuit 81. The control system 110 generally connects via line 114 to the inlet orifice 84 of the second fluid circuit 83 and via line 118 to the outlet orifice 86 of the second fluid circuit 83. The control system 110 generally includes pumps 120 and 122 such as fixed displacement pumps for circulating a cooling and lubricating fluid; filters 124 and 126 for filtering the fluid fluid; and valves, for example, pinch valves, 128, 130, 132 and 134. The valves may, for example, be used to create backpressure on the respective first and second fluid circuits 81, 83 and to energize the floating seal carriers 46, 96, 98 by varying the orifice of the valves 128, 130, 132, and 134. The pressure within the circuits 81, 83 may be independently adjusted or varied by other means, such as, for example, via pumps (not shown).

The thrust bearing 58 shares the thrust load, e.g. 2,000 lbs.-force, exerted by well bore pressure and placed upon the packer assembly 18 and consequently the load placed upon the lower and upper bearings 34, 38 while allowing the rotable body 12 to rotate. Such results in lowering the heat on lower and upper bearings 34, 38 and extending the life of same. By sharing the thrust load, "nibbling" of the first, second and third seals 46, 96, 98 may be decreased to extend the seal life of same. It is also advantageous to lubricate the thrust bearing 58 to counter the heat effects of the thrust load and rotation upon same. This may be accomplished, for example, by a thrust bearing cooling and lubricating circuit 75 which introduces the cooling fluid to the thrust bearing through the opening between the o-rings 74 and 76.

It should be noted that reverse rotation may be utilized during use of the rotary blowout preventer 8 and the invention will be functional under such conditions.

In conclusion, therefore, it is seen that the present invention and the embodiments disclosed herein are well adapted to carry out the objectives and obtain the ends set forth. Certain changes can be made in the subject matter without departing from the spirit and the scope of this invention. It is realized that changes are possible within the scope of this invention and it is further intended that each element or step recited is to be understood as referring to all equivalent elements or steps. The description is intended to cover the invention as broadly as legally possible in whatever form it may be utilized.

What is claimed is:

1. A method for controlling a rotary blowout preventer having a first fluid circuit and a second fluid circuit physically independent from the first fluid circuit mounted over a well bore, comprising the steps of:

introducing a first fluid into the first fluid circuit at a pressure greater than a pressure of the well bore;

introducing a second fluid into the physically independent second fluid circuit at a pressure less than the pressure of the first fluid;

monitoring the pressure of the second fluid in the second fluid circuit and detecting increases in the pressure of the second fluid; and inferring a condition of a seal based on said step for detecting increases in the pressure of the second fluid.

2. The method according to claim 1 further including the step of adjusting the pressure of the first fluid in response to the pressure of the well bore.

3. The method according to claim 1 further including the step of monitoring the pressure of the first fluid.

4. The method according to claim 1 wherein said step of inferring the condition of the seal comprises predicting the condition of excessive wear in the seal for the second fluid circuit in response to said monitoring step.

5. The method according to claim 1 further comprising adjusting the pressure of the second fluid in response to the pressure of the first fluid wherein said adjusting step includes determining an adjusted pressure of the second fluid as a percentage of the pressure of the first fluid.

6. The method according to claim 1, further including the step of controlling the pressure of the second fluid by adjusting an orifice connected to an outlet of the second fluid circuit.

7. The method according to claim 1 wherein the first fluid is introduced into the first fluid circuit at a pressure above the pressure of the well bore sufficient to exert closure.

8. The method according to claim 1, further including bearing a thrust load exerted by the pressure of the well bore by sharing the thrust load between a thrust bearing, an upper bearing and a lower bearing.

9. The method according to claim 8, further including cooling and lubricating the thrust bearing.

* * * * *